US006293445B1

(12) United States Patent
Miller

(10) Patent No.: US 6,293,445 B1
(45) Date of Patent: Sep. 25, 2001

(54) BELT PACK

(75) Inventor: D. Scott Miller, Orlando, FL (US)

(73) Assignee: Dart Industries Inc., Orlando, FL (US)

( * ) Notice: Subject to any disclaimer, the term of this patent is extended or adjusted under 35 U.S.C. 154(b) by 0 days.

(21) Appl. No.: 09/001,810

(22) Filed: Dec. 31, 1997

(51) Int. Cl.[7] ..... A45C 1/04

(52) U.S. Cl. ..... 224/240; 224/236; 224/242; 224/245; 224/247; 224/271; 224/665; 224/679; 224/681

(58) Field of Search ..... 224/191, 660, 224/663, 665, 666, 667, 668, 669, 674, 675, 242, 245, 249, 235, 236, 240, 247, 248, 271, 272, 681

(56) References Cited

U.S. PATENT DOCUMENTS

| | | | | |
|---|---|---|---|---|
| 1,214,161 | * | 1/1917 | Hettinger et al. | 224/247 |
| 1,619,782 | * | 3/1927 | Archila | 224/240 |
| 1,625,920 | * | 4/1927 | Thurman | 224/245 |
| 1,806,477 | * | 5/1931 | Lloyd et al. | 224/679 |
| 1,809,696 | * | 6/1931 | Heilweil | 224/240 |
| 1,815,101 | * | 7/1931 | Goldstein | 224/679 |
| 2,536,725 | * | 1/1951 | Cleveland | 224/679 |
| 3,668,802 | * | 6/1972 | Benward | 224/245 |
| 4,119,248 | * | 10/1978 | Butler et al. | 224/679 |
| 5,009,222 | * | 4/1991 | Her | 224/679 |
| 5,127,537 | * | 7/1992 | Graham | 220/339 |
| 5,397,040 | * | 3/1995 | Lee | 224/240 |

* cited by examiner

*Primary Examiner*—Gregory M. Vidovich
(74) *Attorney, Agent, or Firm*—Taylor J. Ross

(57) ABSTRACT

A belt pack including a rigid bag fixed within a carrier including belt loops with the bag and carrier configured to the waist area of a wearer. The bag includes an integral cover with cooperating latch components on the bag and carrier for releasably retaining the cover closed.

4 Claims, 4 Drawing Sheets

BELT PACK

BACKGROUND OF THE INVENTION

Bags or packs positionable at the waist are well known as a convenient means for a "hands-free" carrying of a variety of items, normally of a personal nature such as glasses, a wallet, pocket change, tissues, and the like.

Such packs are frequently referred to as "fanny packs" as, presumably, they were initially intended to be worn at the small of the back. The conventional pack includes a bag of an appropriate soft fabric, such as Nylon, and waist-encircling straps normally sewn to the fabric bag and provided with end clips for engagement about the waist of a user.

Such known packs, because of the flexible nature thereof, provide little protection for the contents, can be torn, and tend to shift about the waist particularly in light of the nature of the mounting straps. Another deficiency of the known packs is the inability thereof to protect the contents from moisture as when worn in the rain or during the taking of a brief shower when leaving the beach. The necessity of removing the conventional pack when at an outdoor shower defeats the purpose of the pack in retaining one's items protectively on one's person.

As will also be appreciated by anyone familiar with the conventional flexible "fanny pack", in order to accommodate waists of vastly different sizes, the straps normally furnished are quite long and require adjustment with any excess length of strap tucked away in some manner for the sake of appearance.

SUMMARY OF THE INVENTION

The belt pack of the invention, incorporating both a bag and a carrier, mounts directly on the conventionally worn belt of a wearer, avoiding the necessity for extraneous and frequently ill-fitting straps. The bag itself, while incorporating a slight degree of resilient flexibility as is common in synthetic resinous containers to allow for snap-fitting of lids and the like, is basically rigid and includes a relatively deep container body with a high cover integrally formed with the body along a living hinge. When closed, the cover peripherally seals to the body in a manner as to provide a waterproof bag or pack capable of excluding moisture under all but extreme conditions.

The high cover defines a cover chamber which receives a separate tray snap-locked therein for a selective separation of the bag contents as desired.

The rigid nature of the bag provides complete protection for the contents against external disruptive forces. Further, both because of the mounting of the belt pack directly on the normally worn belt of the user, and in light of the specific configuration of the belt pack to conform to the side waist and hip area of a wearer, the belt pack is stabilized in position.

The carrier, which is separately formed from the bag itself, includes integral belt loops which receive the wearer's belt and removably mounts the carrier thereon. The carrier in turn receives the bag itself which is fixedly locked therein in a manner which, while allowing for possible disengagement for replacement of the bag, is basically intended as a permanent joinder wherein accidental disengagement of the bag is precluded. The carrier, in addition to providing a mounting means for the bag, uniquely cooperates therewith in securing the bag cover and providing a positive latch for the cover. Further, the front panel of the carrier, that is the panel remote from the body of the wearer, cooperates with the forward wall of the bag in providing a secure clip for the temporary retention of notes, paper bills, and the like for quick retrieval.

The features of the invention as above described, and further features of the invention will be better understood from the following more detailed description of the invention.

DESCRIPTION OF PREFERRED EMBODIMENT

Figure 1:
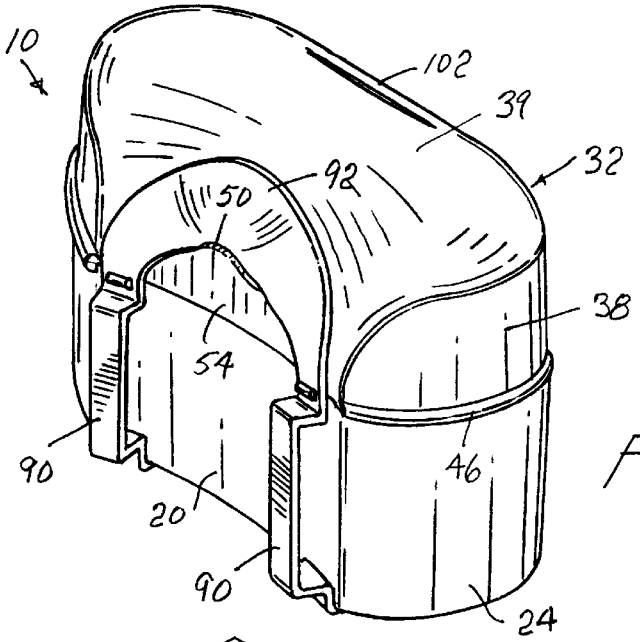
FIG. 1 is a perspective view of the belt pack, including the assembled bag and carrier.

Referring now more specifically to the drawings, the belt pack 10 of the invention comprises three basic components, the bag 12 itself, a removable internal tray 14, and a carrier 16. These components are preferably molded of an appropriate synthetic resinous material, such as polypropylene, and are basically of a rigid construction with an inherent degree of resilient flexibility for manipulation in a manner to be described subsequently.

The bag 12 includes a container base 18 with a concave rear wall 20, the rearwardly directed concavity extending for the full height of the rear wall 20 and formed to generally conform to the side waist and/or hip area of a wearer. The front wall 22 of the container is preferably planar or flat along at least the major central portion thereof. The rear and front walls 20 and 22 are integrally joined by opposed mirror-image end walls 24 extending along eccentric arcs wherein the base 18 is of a generally kidney shape in horizontal cross section.

The walls 20, 22 and 24 are of equal height upward from a planar bottom 26 integrally molded with the lower edges of the walls and conforming to the body configuration defined by the walls. As noted in FIG. 5, the walls, and in particular the rear and front walls 20 and 22, may diverge slightly upward from the bottom 26 with the coplanar upper edges of the walls forming a continuous upper body edge defining the open mouth of the relatively deep body. These wall upper edges include a continuous, vertical extending, sealing flange 28. The flange 28 is narrower than the walls and in turn defines a continuous, inner, upwardly directed sealing shoulder 30 peripherally about the interior of the walls adjacent the upper edges.

The base 18 is selectively closed by a cover 32 of a horizontal configuration conforming to that of the base 18. The cover 32 includes a concave rear wall 34, a generally planar front wall 36, and arcuate end walls 38 defining a relatively deep cover chamber. The cover rear wall 34, in addition to the concave configuration thereof in horizontal section, arcs upwardly and forwardly to join the generally planar top wall 39 which in turn is integral with the upper edge of the front wall 36.

Figure 8:
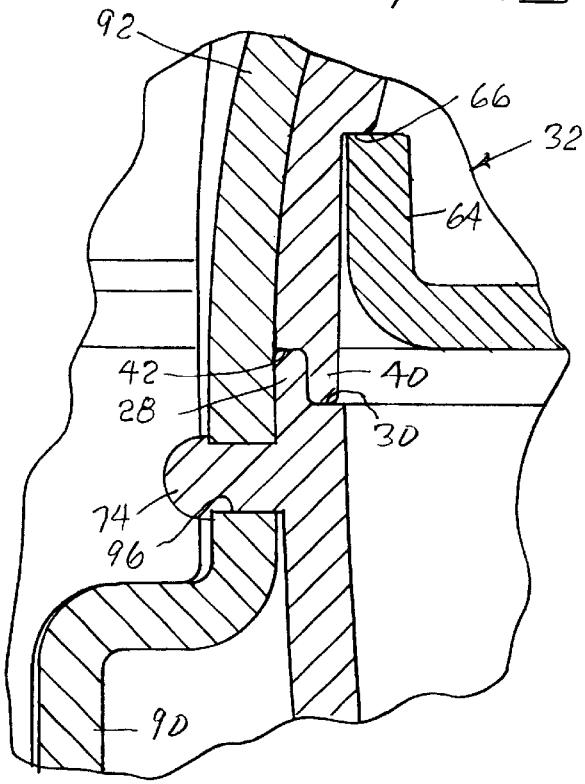
FIG. 8 is an enlarged sectional detail illustrating a lock assembly between the bag and carrier.
Figure 9:
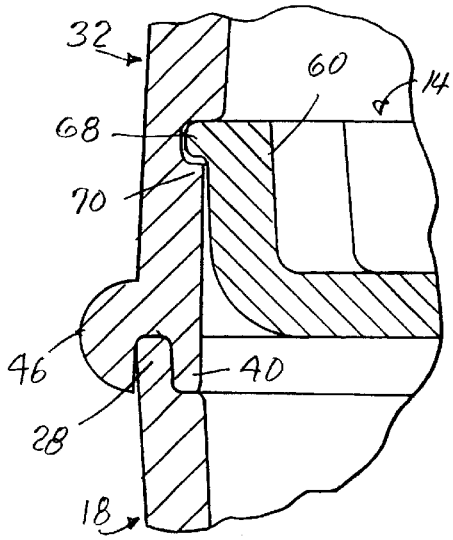
FIG. 9 is an enlarged sectional detail taken substantially on a plane passing alone line 9—9 in FIG. 4 and illustrating the tray retention means.

Noting in particular the cross-sectional detail of FIGS. 8 and 9, the lower edges of the cover walls include a continuous depending sealing flange 40 which in turn defines a downwardly directed sealing shoulder 42 immediately outward thereof and peripherally about the lower edge of the cover 32. Upon a closing of the cover 32 over the base 18, the flange 28 and shoulder 30 of the body receive, in a substantially sealed manner, the shoulder 42 and flange 40 of the cover with the combined thicknesses of the side-by-side engaging flanges 28 and 40 approximately equaling the wall thicknesses of the body and cover.

Figure 2:
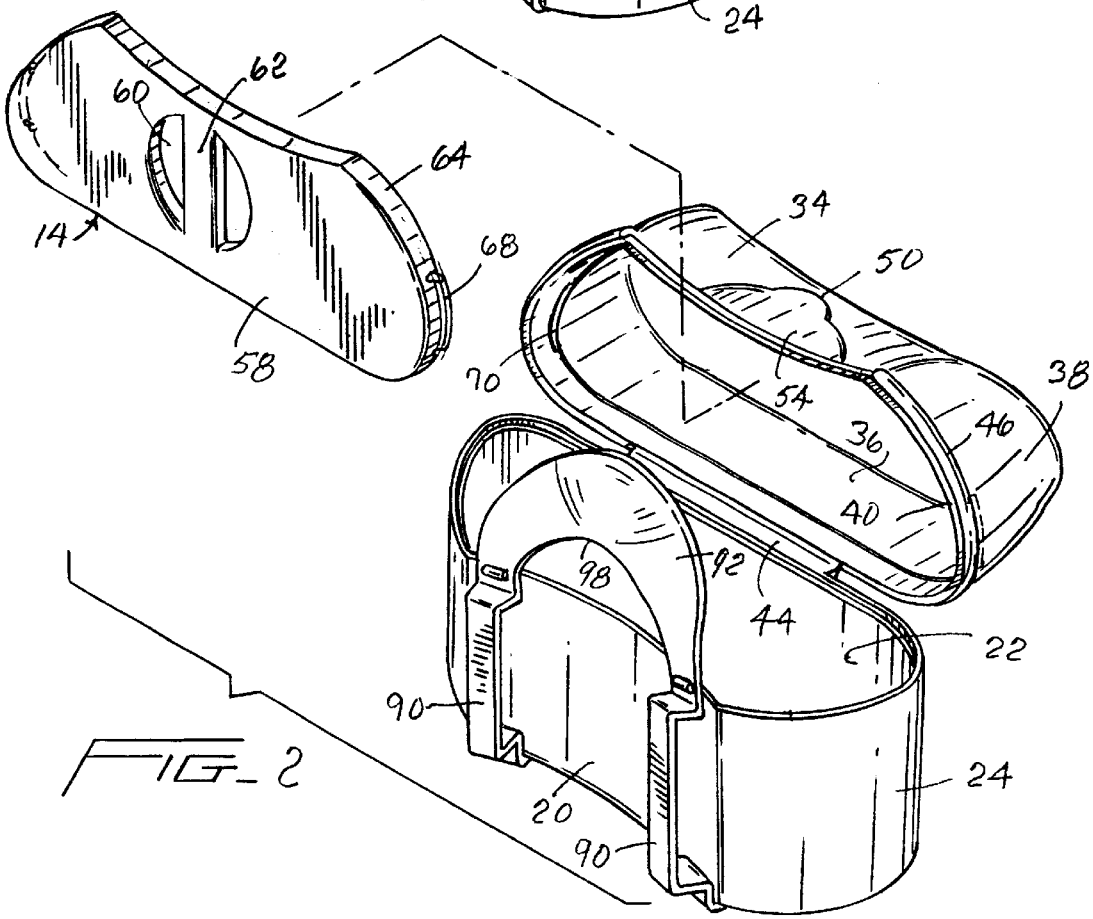
FIG. 2 is a similar perspective view with the bag cover open and the storage tray removed.
Figure 5:
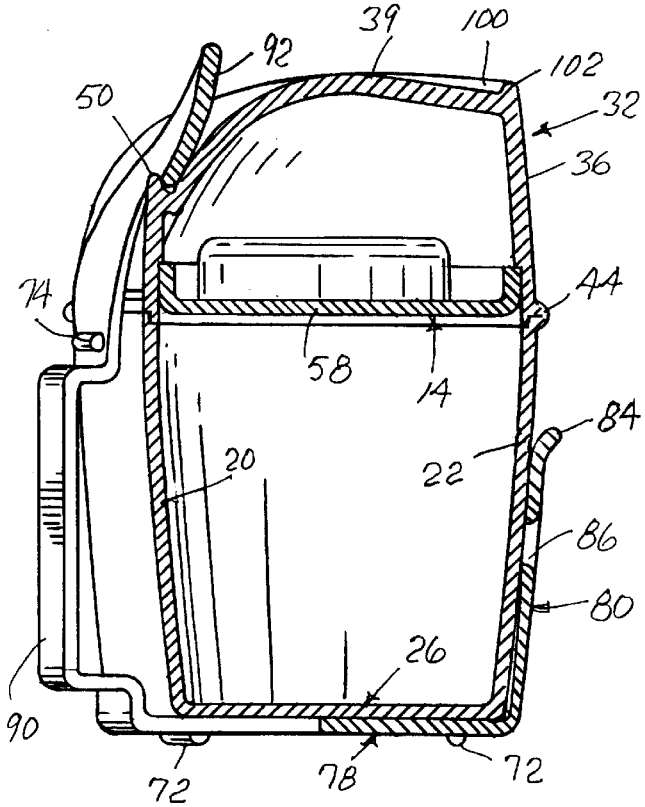
FIG. 5 is a transverse cross-sectional view taken substantially on a plane passing along line 5—5 in FIG. 4.

Noting FIGS. 2 and 5 in particular, the upper edge of the body front wall 22 and the lower edge of the cover front wall 36 are integrally joined by an elongate living hinge 44 with the cover 32, when opened, pivoting upwardly and forwardly over the body front wall 22.

Noting FIGS. 2 and 9 in particular, an outwardly extending bead 46 will preferably be integrally formed on and along the cover end walls 38 and that portion of the cover front wall 36 to each side of the living hinge 44 in outwardly spaced relation to the cover sealing flange 40 to define a sealing groove receiving the body flange 28 to enhance the seal and provide for a further stabilization of the closed cover relative to the container body 18. This bead 46, for convenience in mounting the base 18 to the carrier 16, does not extend along the cover rear wall 34. It is to be appreciated that the inherent flexible resiliency of the otherwise rigid body and cover ensure a positive and tight closure of the cover to the body, providing a substantially waterproof container other than for under extreme conditions, for example prolonged complete immersion in a body of water.

The outer surface of the arcing rear wall 34 of the cover 32 includes a rearwardly offset upwardly directed lip 50 defining an upwardly directed latching groove 52. As illustrated, this lip 50 can constitute the apex area of a molded wall portion 54 extending vertically from the lower edge of the cover rear wall 34 with the forward arcing of this wall 34 relative to the upper edge of the vertical wall portion 54, defining the latching lip 50 and latching groove 52.

The height of the cover 32 and hence the chamber defined therein, is significant in providing for a separate storage compartment selectively closed by the removable bottom tray 14. The tray 14 has a flat bottom 58 with adjacent upwardly directed recesses 60 therein defining, with the central bar 62 therebetween, a finger grip for insertion and removal of the tray. The tray further includes a continuous peripheral wall 64 which, upon a full insertion of the tray, seats against a continuous downwardly directed shoulder 66 defined about the interior of the cover walls and spaced sufficiently above the lower edges thereof as to provide for a slight recessing of the tray within the cover. The tray 14, at selected areas about the upper edge of the peripheral wall 64, preferably corresponding to the cover end walls 38, include outwardly directed elongate lips 68 which snap-lock over shoulder portions 70 defined on the cover wall inner surfaces in closely spaced relation below the cover shoulder 66 for a releasable retention of the tray until physically removed. As will be appreciated, the configuration of the tray 14 corresponds to that of the cover 32 about the lower portion thereof, and is intended to engage within the cover about the entire periphery of the tray for a positive retention of contents within the cover chamber.

The bag 12 is completed by four integral depending locking lugs 72 on the bottom or bottom wall 26, two of such lugs 72 being spaced longitudinally adjacent each of the front and rear walls. Two similar locking lugs 74 are integrally formed with the rear wall 20 in spaced relation below the upper flange edge thereof and toward the opposed sides of the wall 20. Each of the lugs 72 and 74, preferably includes an enlarged outer locking head.

Turning now to the carrier 16, it is to be appreciated that this carrier uniquely combines with the bag 12 itself in providing multiple functions including the actual mounting of the bag to the wearer, the provision of cooperating latch means for the bag cover, providing an auxiliary storage pocket for loose papers, and the like.

The carrier 16 includes a bottom panel 78, and a front panel 80 integral with the front or outer edge of the base and extending generally perpendicular thereto. The front panel terminates in an upper edge 82 with a central forwardly turned elongate gripping lip 84. As desired, viewing apertures 86 may be provided through the front panel 80, such apertures also reducing the amount of material required and the overall weight of the assembly.

The carrier 16 also includes a rear panel 88 which is integrally formed with the bottom panel 78 and basically comprises a pair of laterally spaced, rearwardly offset, vertically elongate belt loops 90 integrally joined at the upper ends thereof by a transversely arcing panel portion 92. In order to conform to the concave rear wall 22 of the bag body, the carrier rear panel 88, or more particularly the belt loops 90 and arcuate panel portion 92 define a generally concave configuration with the upper panel portion also arcing upwardly and forwardly to generally conform to and partially overlie the cover rear wall 34.

As will be appreciated from the drawings, the bag 12 is introduced into the carrier 16 with the bottom locking lugs 72 snap-engaged through corresponding bottom slots 94 on the bottom panel 78 of the carrier. Similarly, the rearwardly directed locking lugs 74 on the rear wall 20 of the bag body are snap-engaged through corresponding slots 96 on the carrier rear panel 88 immediately above the rearwardly offset belt loops 90. When so mounted, release of the bag 12 from the carrier 16 is effectively precluded in the absence of substantial manual pressure, whereby any accidental release of the bag from the carrier is not possible. The bag is snugly received between the front and rear panels 80 and 88 of the carrier with the rearward offset of the belt loops 90 being sufficient to receive the wearer's belt therethrough.

Figure 6:
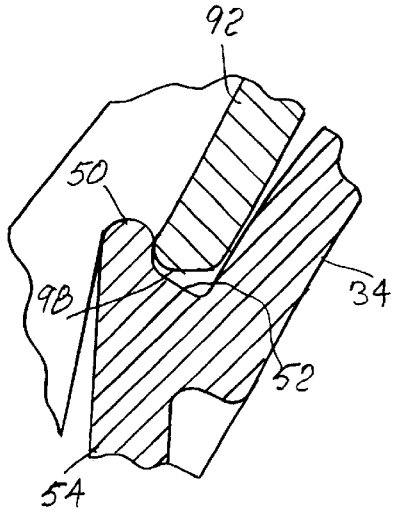
FIG. 6 is an enlarged sectional detail of the cooperative cover latch components.
Figure 7:
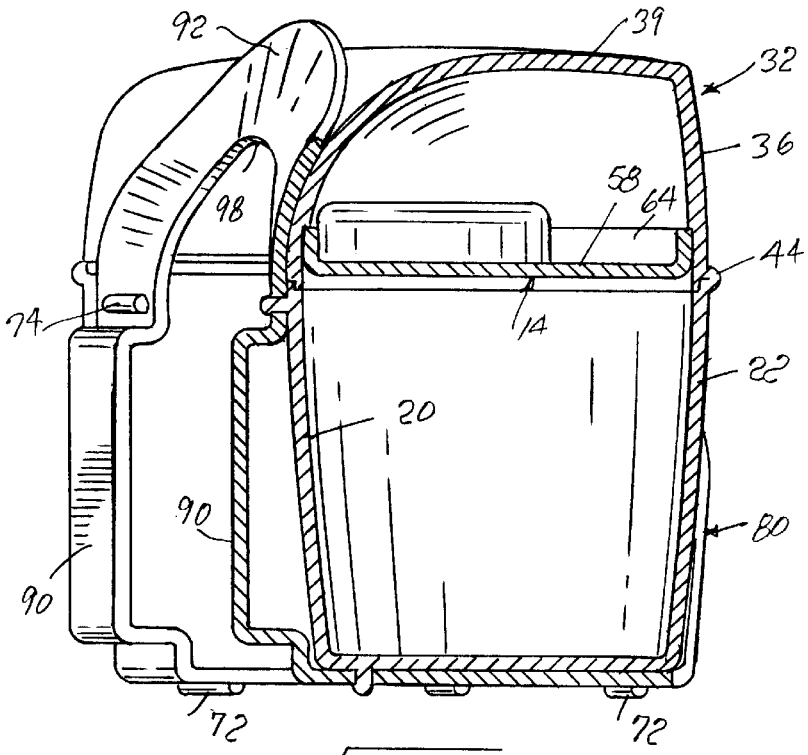
FIG. 7 is a cross-sectional detail taken substantially on a plane passing along line 7—7 in FIG. 4.

As noted above, a significant function of the carrier is to also retain the cover 32 closed. As such, the arcuate panel portion 92 has the edge portion 98 so positioned as to define a companion latch component engageable, noting FIGS. 5 and 6, over the cover lip 50 and within the cover latching groove 52 whereby an upward and forward pivoting of the cover is precluded. In order to release the cover, a positive engagement and rearward flexing of the panel portion 92 toward the wearer, so as to release the edge portion 98 thereof from the cover latch components 50 and 52, is required. When so released, the cover is free to upwardly and forwardly pivot to expose the interior of the bag with the interior of the cover facing toward the wearer for physical and visual access to the interior of the container body and the cover. In order to facilitate this opening of the cover, a shallow recess 100, with a gripping ridge 102 may be formed on the top wall 39 of the cover adjacent the cover front wall 36, note for example FIG. 5. Also, the living hinge 44 may be such as to provide a constant opening bias on the cover whereby upon a release of the latch components 50, 52 and 98, the cover will spring slightly open for easy grasping and manipulation.

In closing the cover 32, the lip 50 will engage the forward surface of the panel portion 92 and rearwardly flex this portion until the lip moves into substantial alignment with the latching edge panel portion 98, at which point panel portion 92 is flexed forward to engage the edge portion 98 over the lip 50.

A further significant aspect of the bag and carrier assembly is the cooperation between the front wall 22 of the base and the front panel 80 of the carrier whereby, noting for example FIG. 5, the carrier front panel 80, and more particularly the upper gripping lip 84 thereof, can be slightly forwardly flexed to allow for the insertion of notes, paper bills and like items for which quick retrieval might be desired.

Figure 3:
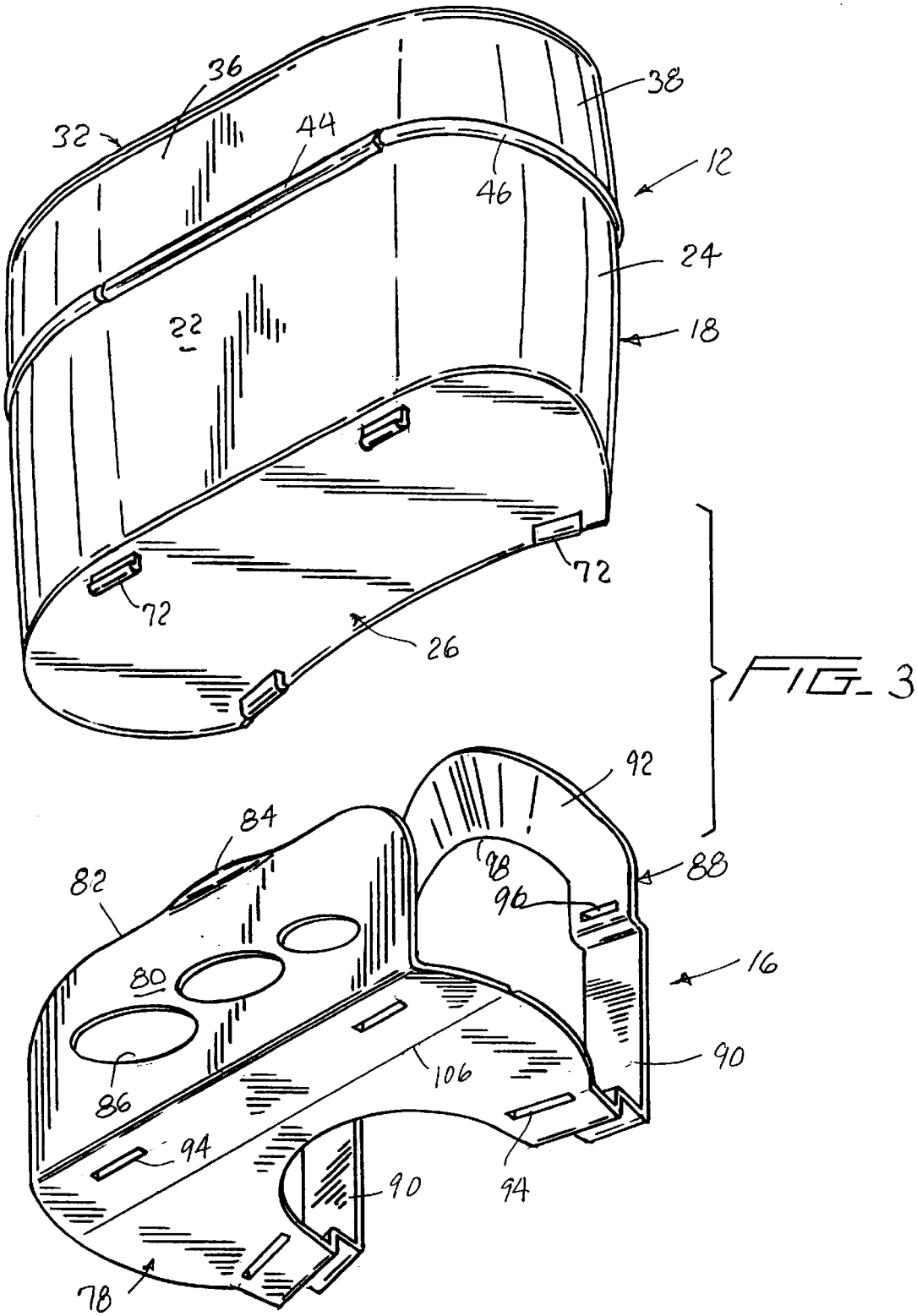
FIG. 3 is a perspective view with the bag exploded from the carrier.
Figure 4:
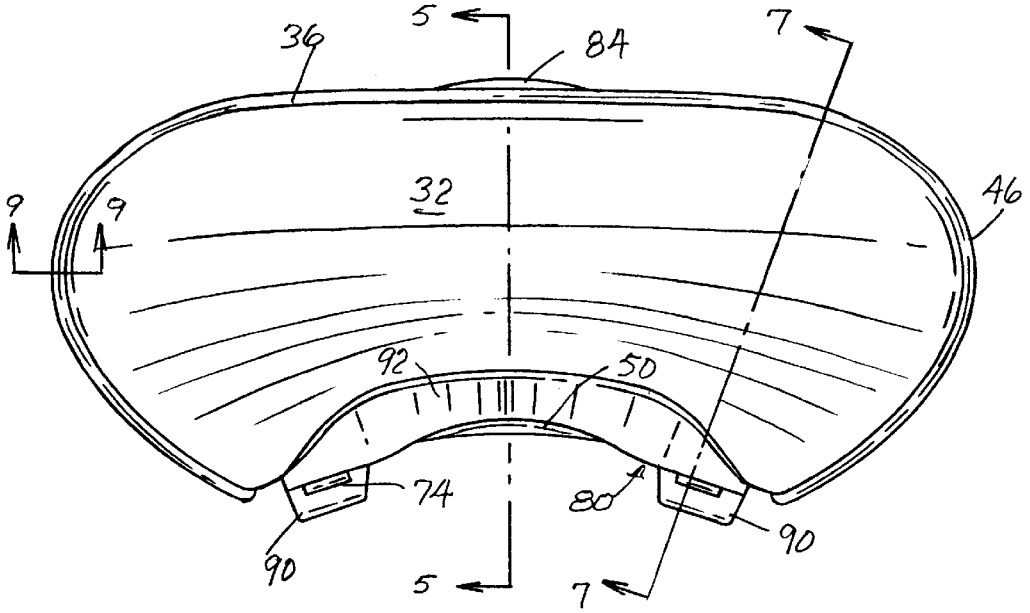
FIG. 4 is a top plan view of the assembled belt pack.

Noting FIG. 3, the bottom panel 78 of the carrier 16 may include a central integral living hinge 106 for facilitating the molding of the carrier and/or the mounting of the carrier to the bag 12.

From the foregoing, it will be appreciated that a unique body-mounted pack has been disclosed, with the pack assembly providing for significant structural and functional improvements not heretofore available. It is to be appreciated that the foregoing is illustrative of the principles of the invention, and the invention, while set forth in conjunction with a preferred embodiment of the invention, is only to be limited by the claims appearing hereinafter.

I claim:

1. A belt pack, comprising:

a bag having a substantially rigid construction including a base having a bottom and front, rear and end walls extending upward from a periphery of said bottom, said front, rear and end walls defining a mouth, said rear wall being concave to conform to the waist area of a user, said bag further including a cover hinged to said front wall and movable between an open position providing access to said mouth and a closed position covering said mouth, said cover including a lip extending upward therefrom adjacent said rear wall; and a carrier including a bottom panel sized to support said bottom thereon, a front panel extending upward from said bottom panel and positioned to engage said front wall when said bottom of said bag rests on said bottom panel, and a rear panel extending upward from said bottom panel and positioned to engage said rear wall when said bottom of said bag rests on said bottom panel, said rear panel having the form of an inverted U with uprights of said U connected to said bottom panel, said uprights of said U further including portions offset rearwardly to define beltloops having open front faces which are closed by said rear wall, and wherein a crossbar of said U defines a panel portion which is engageable with said lip to retain said cover in said closed position.

2. A belt pack as in claim 1, wherein said bag further includes a plurality of locking lugs extending downward from said bottom, each of said locking lugs having an enlarged free end, and wherein said carrier further includes a like number of bottom slots extending through said bottom panel at positions to receive said locking lugs, said locking lugs, when received within said bottom slots, serving to retain said bag to said carrier.

3. A belt pack as in claim 2, wherein said cover includes a top wall, and front, rear and end walls extending downward from a periphery of said top wall, said front, rear and end walls of said cover defining a chamber within said cover.

4. A belt pack as in claim 3, further including shoulder portions on an inner face of said front, rear and end walls of said cover, said shoulder portions being spaced from said top wall, and further including a bottom sized to be received within said front, rear and end walls of said cover and to abut said shoulder portions, and cooperating lock components on said bottom and said cover for releasably retaining said bottom within said chamber, said bottom of said cover thus serving to selectively segregate a portion of said chamber.

* * * * *